US005257711A

United States Patent [19]

Wirtz-Odenthal

[11] Patent Number: 5,257,711

[45] Date of Patent: Nov. 2, 1993

[54] APPARATUS FOR DISPENSING WEB SECTIONS FROM A DISPENSER ROLL

[75] Inventor: Bernhard Wirtz-Odenthal, Korschenbroich, Fed. Rep. of Germany

[73] Assignee: Scott-Feldmühle GmbH, Düsseldorf, Fed. Rep. of Germany

[21] Appl. No.: 768,642

[22] PCT Filed: Feb. 8, 1991

[86] PCT No.: PCT/EP91/00244

§ 371 Date: Oct. 1, 1991

§ 102(e) Date: Oct. 1, 1991

[87] PCT Pub. No.: WO91/11947

PCT Pub. Date: Aug. 22, 1991

[30] Foreign Application Priority Data

Feb. 10, 1990 [DE] Fed. Rep. of Germany ..... 4004124

[51] Int. Cl.[5] ..... A47K 10/36; B65H 35/06

[52] U.S. Cl. ..... 225/14; 325/15; 325/72; 325/73

[58] Field of Search ..... 225/10, 12, 13, 14, 225/15, 16, 47, 72, 73, 82; 242/55.53; 83/335

[56] References Cited

U.S. PATENT DOCUMENTS

| | | | |
|---|---|---|---|
| 2,193,759 | 3/1940 | Birr | 225/16 X |
| 2,206,320 | 7/1940 | Grunwald | 225/16 |
| 2,592,786 | 4/1952 | Birr | 242/55.53 |
| 2,974,839 | 3/1961 | Batlas et al. | 225/12 |
| 3,107,957 | 10/1963 | Batlas et al. | 225/12 X |
| 4,131,044 | 12/1978 | Cassia | 83/205 |
| 4,188,844 | 2/1980 | DeLuco | 83/337 |

FOREIGN PATENT DOCUMENTS

| | | |
|---|---|---|
| 0206952 | 12/1986 | European Pat. Off. . |
| 0275806 | 7/1988 | European Pat. Off. . |
| 2132756 | 3/1972 | Fed. Rep. of Germany . |
| 2623120 | 6/1977 | Fed. Rep. of Germany . |
| 2639810 | 3/1978 | Fed. Rep. of Germany . |
| 2922581 | 1/1980 | Fed. Rep. of Germany . |
| 2836709 | 3/1980 | Fed. Rep. of Germany . |
| 3690545 | 4/1987 | Fed. Rep. of Germany . |
| 8300737 | 7/1984 | France . |
| 409286 | 3/1966 | Switzerland . |

*Primary Examiner*—Eugenia Jones

*Attorney, Agent, or Firm*—Brumbaugh Graves Donohue & Raymond

[57] ABSTRACT

In an apparatus for dispensing web sections from a roll the apportioning roll (1) is provided with a friction lining (2) and has a spiral guide (3) for actuating a thrust member (6). The thrust member (6) carries a knife (12) and is held in the spiral guide (3) by a return spring (15). A release anchor (10) is arranged for rotation on the thrust member (6) and includes stopper surfaces (17, 82) which may be in engagement with a stop (18) on the end surface (43) of the apportioning roller (1), providing a lock for preventing further rotation of said apportioning roll. When the paper web (39) is withdrawn across the apportioning roller (1), the apportioning roller (1) is rotated, the knife (12) is moved from its inoperative position into working position, the lock being actuated at the same time. Tearing off the paper web (39) at the knife (12) pivots the knife, whereby the lock is released, the apportioning roller (1) is turned by a few degrees to the second inner stopper surface (82), and the knife (12) is retracted into the starting position.

9 Claims, 8 Drawing Sheets

APPARATUS FOR DISPENSING WEB SECTIONS FROM A DISPENSER ROLL

The invention relates to an apparatus for paying out web sections from a dispenser roll, wherein a slide surface moves a cutter member between an inoperative position during discharge and an operative position when a locking means is caught, the slide surface thus being stopped, the cutter member returning into the position of rest upon release of the locking means.

Apparatus for paying out web sections from a roll are known especially as paper towel dispensers. For this reason the invention will be described below with reference to a paper towel dispenser without, however, being restricted to this example. With the known towel dispensers, the user grasps the edges of the paper towel protruding at the right and left and pulls a length thereof from the supply roll. The dispensers in general are designed so that only a certain length can be withdrawn, and then the paper web is arrested. The user now may pull it against a serrated cutting edge disposed in the dispenser or at the dispenser so as to sever the web length pulled off from the supply roll. The tearing edge which usually is of toothed design is located in the direct vicinity of the leading end of the web which hangs out of the dispenser. Thus there is a risk that the user grasping the web will hurt himself at the tearing edge.

It is, therefore, the object of the invention to provide a dispenser which has a cutting member not located in the area of the hands of a user when he grasps the web so that, consequently, the cutting member cannot be touched.

A cutting mechanism for paper towel dispensers is known from DE-OS 28 36 709 operating with a movable knife which is located within the dispenser casing and acts in the manner of scissors. The paper web to be penetrated thus is moved by means of a crank drive between a stationary knife and a movable knife, the cutting of a web length taking place by spring pressure. The spring is tensioned by the slide surface which is wrapped in part by the paper web, and released by further mimics.

It is a disadvantage of this structure that rather strong forces must be exerted at the paper web to tension the knife actuating spring in order that the slide surface may be moved so as to tension the spring. In view of the fact, however, that such a paper web serves for drying wet hands, which means that it is always grasped with wet hands, the moisture dramatically reducing the strength of the paper, there is a risk that the leading end of the paper web hanging out will tear off without a sheet length first having been unwound.

It is another disadvantage that two knives must be used and that these knives slidingly pass each other accurately and, as a result, the cutting edges become blunt due to normal wear, a clean cut no longer can be achieved, and consequently paper jamming in the knife area is preprogrammed These circumstances are to be avoided by the instant invention.

In an apparatus for paying out web sections from a dispenser roll, wherein a slide surface moves a cutter member between an inoperative position during discharge and an operative position when a locking means is caught, the slide surface thus being stopped, the cutter member returning into the position of rest upon release of the locking means, this problem is solved by the combination of the following features: the slide surface is embodied by an apportioning roller provided with a friction lining, its end surfaces are provided with a spiral guide to guide a thrust member to which a knife is pivotably connected, a knife lever with a return spring engages in the joint which connects the knife to the thrust member, the backside of the knife is provided with a knife bolt which engages in a release anchor, the release anchor is rotatably connected to the thrust member by a stay bolt and provided at its anchoring surfaces with stopper surfaces which constitute the locking means, together with the stop on the end surface.

When the dispenser is ready for operation the leading end of the web hangs out from the dispenser by such a length that a user can grasp it conveniently. Pulling at the beginning of the web will turn the apportioning roller which is provided with a friction lining to guarantee safe transport In addition, a contact pressure roller makes sure that the paper web will be guided on to the apportioning roller as soon as possible and be pressed against it so that a large wrap angle will be obtained The loading of the paper web during withdrawal is minor because all that must be overcome is the effect of a return spring which holds the thrust member in engagement with the spiral guide. Thus the paper web can be pulled out securely even with wet hands without the leading end of the web tearing off due to the reduction in strength caused by the effect of moisture.

As the web is being pulled off, the hands of the user move away from the dispensing container. After approximately half the sheet length has been paid out, the knife begins to advance and will be in operating position in which it is covered by the paper web, i.e. the towel, when the full sheet length has been unwound. The web is severed by pulling the web against the knife; at the same time, the knife is tilted forwardly into another position, a circumstance which causes release of the locking of the apportioning roller. That makes a transport device, to be explained later on, enter into action, rotating the apportioning roller by a few degrees up to the second stop, whereby the knife is retracted by the return spring into starting position and, at the same time, the paper web is transported a little further so as to be easier to be grasped.

According to a preferred embodiment of the invention the spiral guide is formed as a recess in at least one end surface of the apportioning roller. Conveniently, however, both end surfaces are equipped with identical spiral guides so that the knife can be moved without tilting by thrust members arranged in parallel. The thrust members advantageously have noses engaging in the spiral guide and thus permitting the movement.

The joint which links the thrust member with the knife and knife lever fixes a pivot point. The opposite guide means may be arranged as an outer parallel guide in the housing. Yet a preferred embodiment of the invention provides for the thrust member to be formed with an oblong aperture in its upper area. According to another preferred embodiment that oblong aperture embraces the shaft of the apportioning roller, whereby the thrust member is guided in this area.

A preferred embodiment of the invention provides to connect the apportioning roller to a cam segment having a transport surface which engages a transport lever loaded by a transport spring. During the rotation of the apportioning roller the transport lever rests on the cam segment, being held there by the transport spring. Its rise continuously presses away the lever, whereby the transport spring is tensioned. When the withdrawal of the paper web is arrested, i.e. when the stopper surface of the release anchor engages the stop of the apportioning roller, the outermost point of the rise of the cam segment has been reached and the transport lever engages the transport surface of the cam segment, i.e. that the transport spring is tensioned. When the paper web has been torn off the knife tilts back, thus freeing the lock, i.e. the stop no longer rests on the first stopper surface, the apportioning roller is rotated by a few degrees by spring pressure until the second stopper surface is reached. Hereby some more length of paper web is conveyed forward. At the same time the knife glides back into starting position.

The invention will be described below with reference to the drawings.

FIG. 9 is a partial side-elevation of an alternative embodiment of the dispenser in accordance with the invention.

Figure 1:
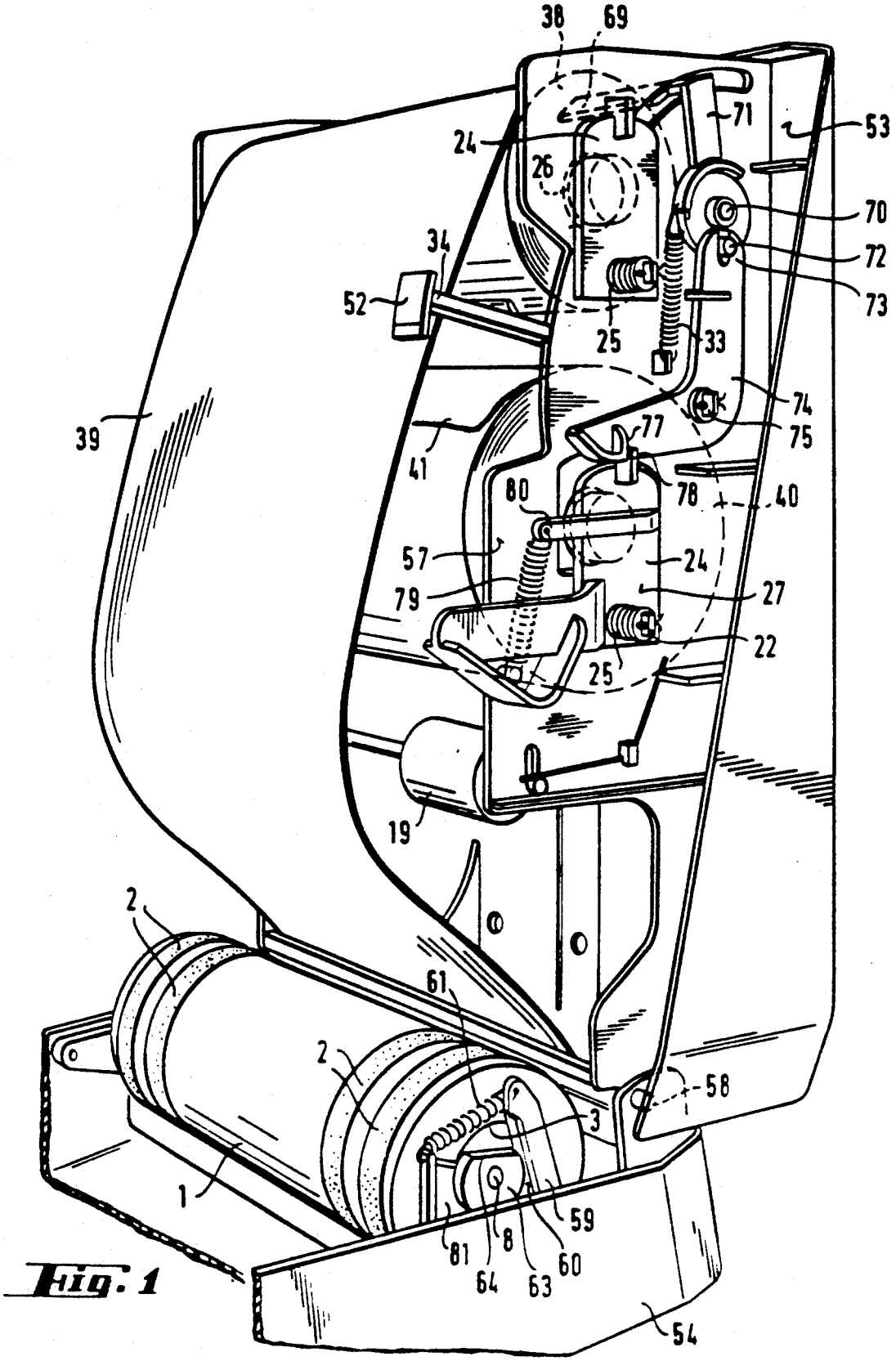
FIG. 1 illustrates, in perspective, the towel roll dispenser in accordance with the invention, with the cover open.
Figure 2:
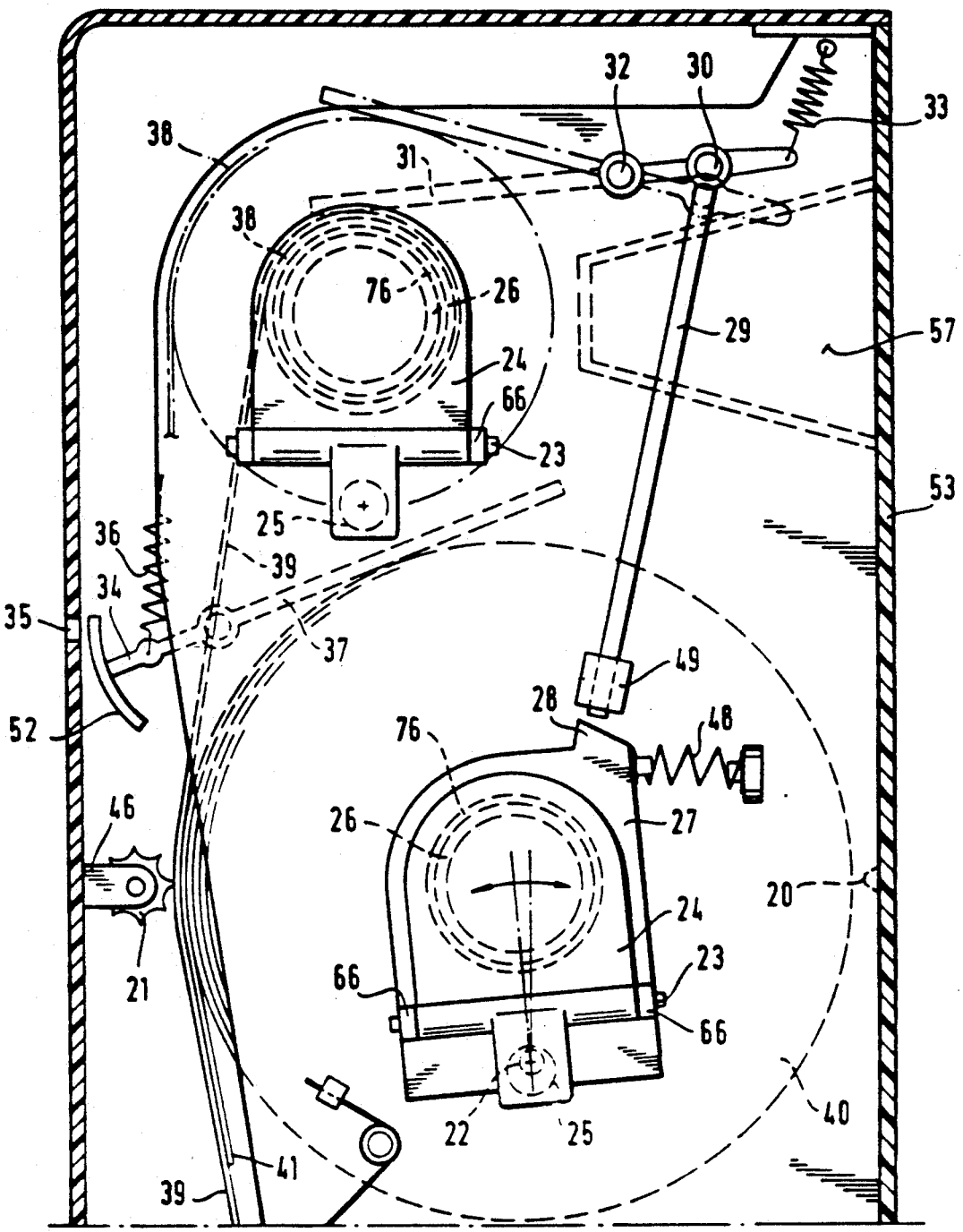
FIG. 2 is a side elevation partial cross-section through the upper part of the towel dispenser, showing the two dispenser rolls in position.
Figure 3:
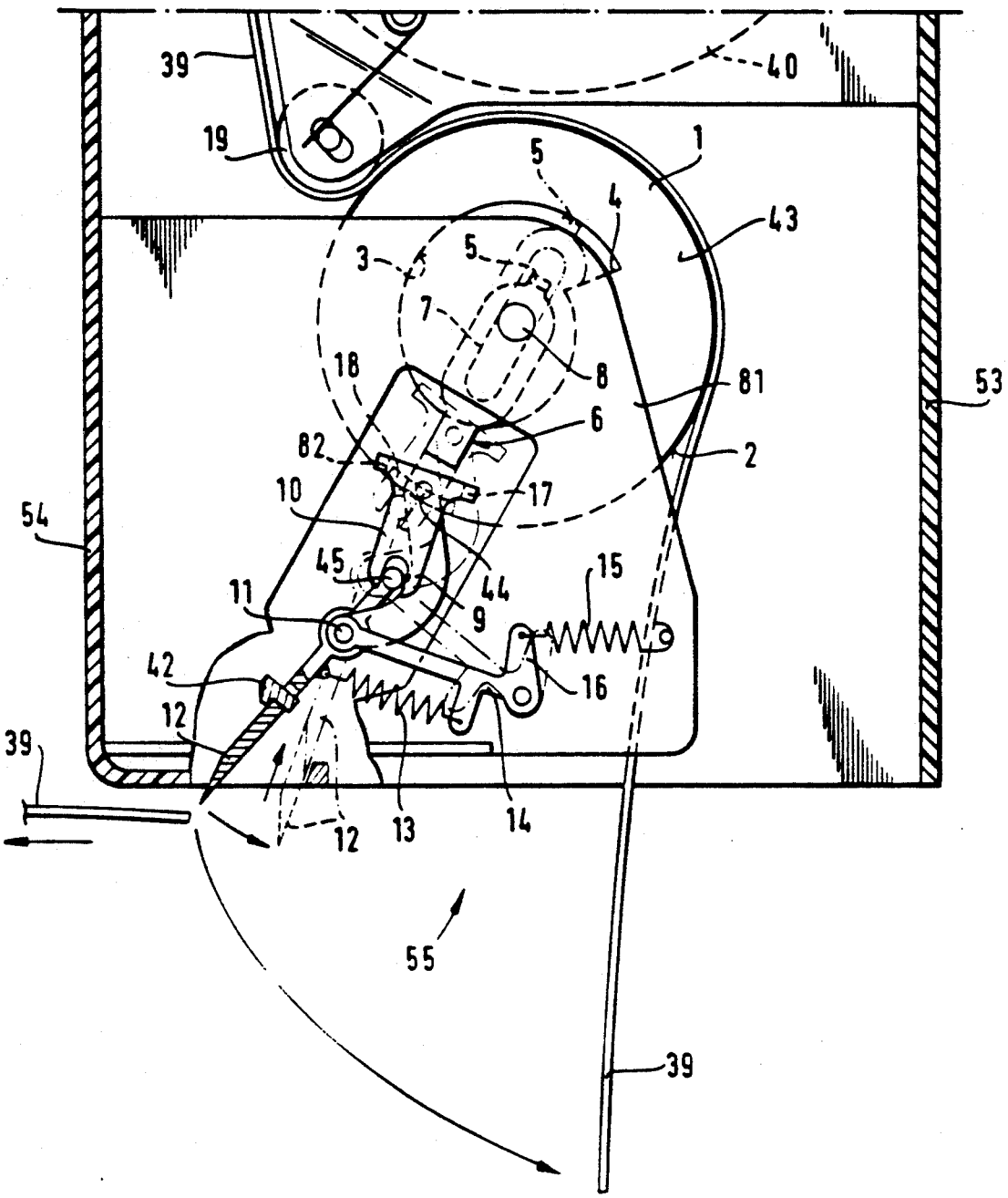
FIG. 3 is a side elevation partial cross-section through the bottom part of the towel dispenser showing the web cut-off mechanism.
Figure 4:
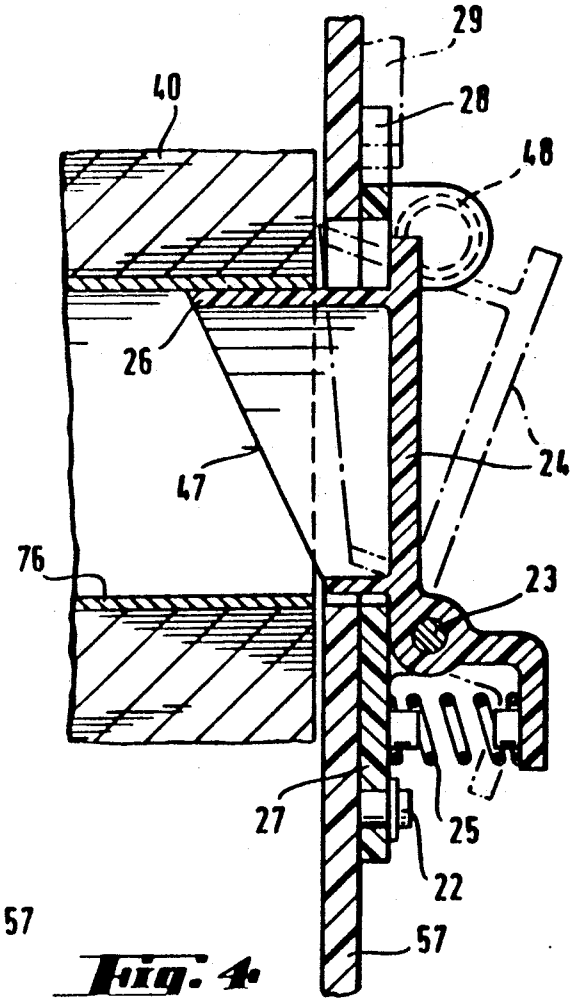
FIG. 4 is a partial cross-sectional view illustrating the tilting bearings for supporting the supply rolls in the dispenser of the invention.
Figure 5:
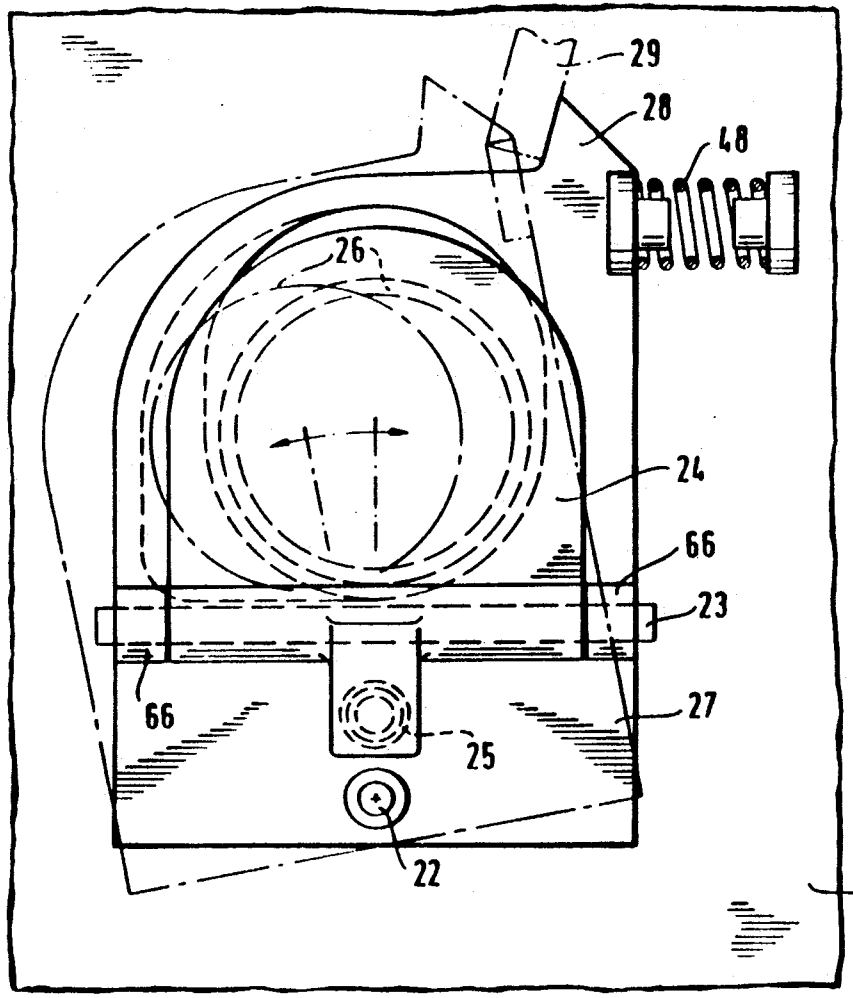
FIG. 5 is a side view of the tilting bearing structure for supporting the supply rolls.
Figure 6:
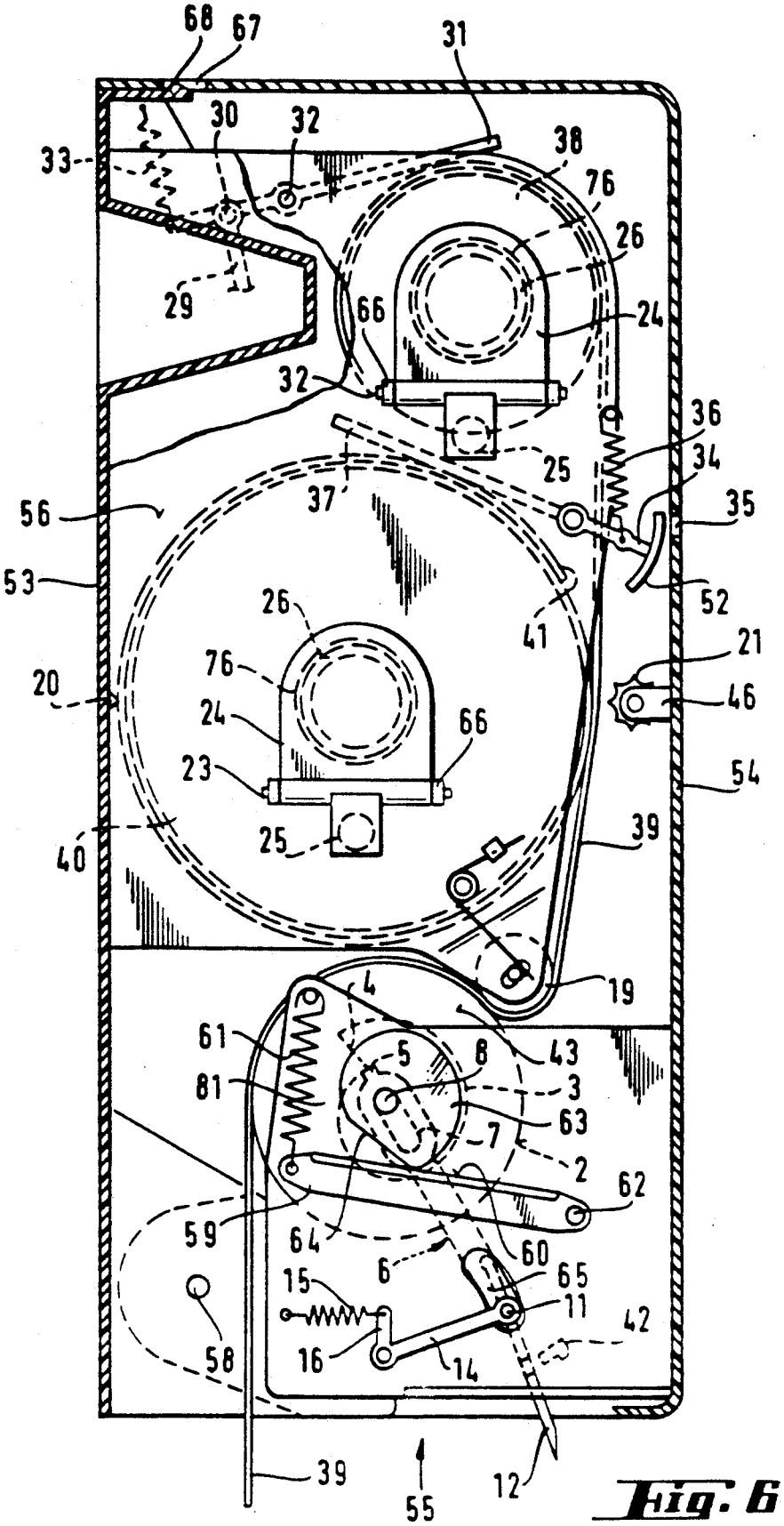
FIG. 6 is a full-length side elevation showing the internal structure of the dispenser from the side opposite that of FIGS. 2 and 3.
Figure 7:
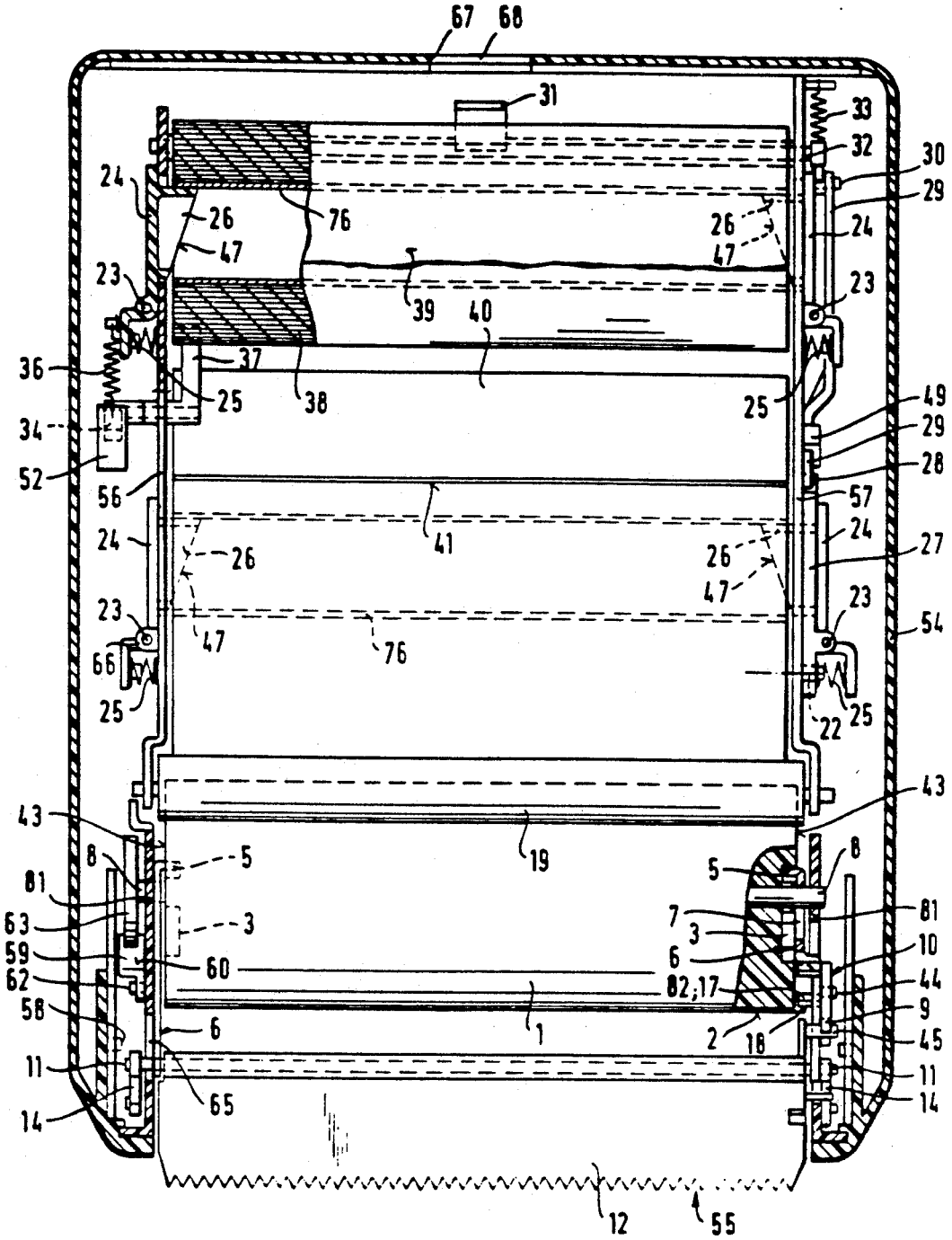
FIG. 7 is a front elevation of the dispenser, in partial cross-section, showing its internal structure.
Figure 8:
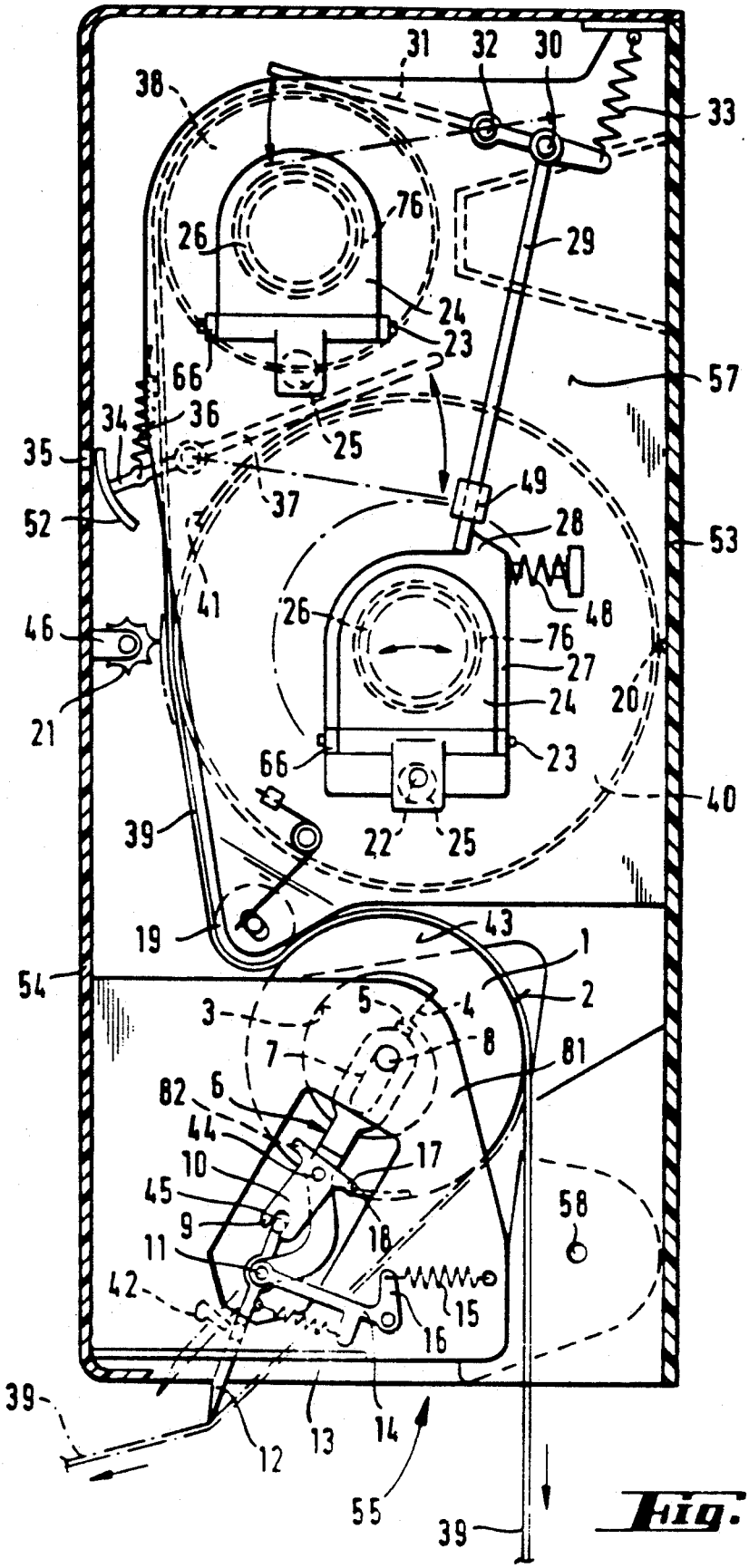
FIG. 8 is a full-length side elevation showing the internal structure of the dispenser, from the side opposite that of FIG. 6.
Figure 8:
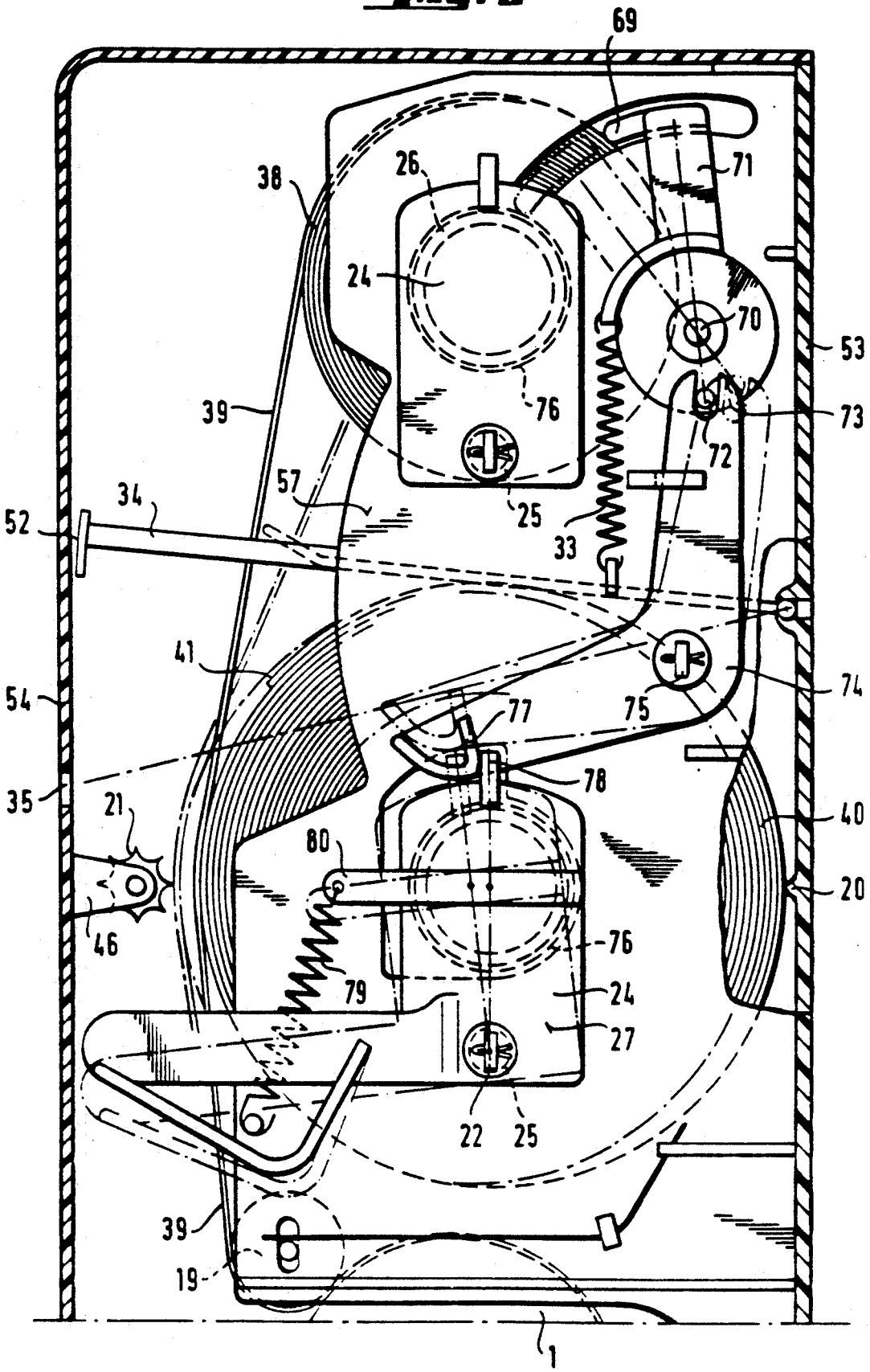

An apportioning roller 1 provided with a friction lining 2 disposed in the lower range of the sheet distributor. The end faces of the apportioning roller 1 comprise a spiral guide 3 each engaged by a nose 5 of a thrust member 6. By its oblong aperture 7 the thrust member 6 surrounds the shaft 8 of the apportioning roller 1. When the apportioning roller 1 is moved in clockwise sense by pulling of the paper web 39, the nose 5 rides in the spiral guide 3, thereby moving the thrust member 6.

At the end opposite the nose 5, the thrust member 6 which is of elbow shape in its lower range includes a joint 11 which connects it to the knife 12 and the knife lever 14 which is pivotably supported on the bearing blocks 81 of the apportioning roller 1 and passes through the outout 65 formed in the bearing blocks 81. The knife 12 embodied by a serrated knife blade projects beyond the joint 11 by its rear portion where it comprises knife bolts 45 engaging in the fork 9 of the release anchor 10.

The release anchor 10 which is connected in articulated fashion to the thrust member 6 by a stay bolt 44 includes a stopper surface 17 at the outside at one anchor face and the inner stopper surface 82 at the inside at the other anchor face. When the paper web 39 is pulled off over the apportioning roller 1 the latter is rotated. The stops 18 provided on its end surfaces 43 thus hit the stopper surfaces 17 of the release anchors 10 which cooperate with both end surfaces 43. In this arrest position of the apportioning roller 1 one web length has been payed out. At the same time the thrust member 6 has moved into its outermost position, whereby the knife 12 was moved outwardly and consequently into the area of the paper web 39 which was pulled out. The knife 12 now engages the paper web 39. Further pulling causes the paper web 39 to be severed, releasing web section 50. Simultaneously the knife is moved against the direction of spring pressure of the knife spring 13 until it stops at a return catch 42, whereby the release anchor 10 is rotated about the stay bolt 44 by means of the knife bolt 45 which engages in the fork 9 of the release anchor 10 so that the stopper surface 17 will lift off the stop 18. In this position the knife 12 is caught by the return catch 42 and will not be drawn back by the knife spring 13 until the web section 50 has been severed s that the knife 12 no longer is subjected to pull. Spring actuated advance, to be explained later on, rotates the apportioning roller 1 onwards by a few degrees in clockwise sense until the stop 18 abuts against the inner stopper surface 82 and arrests the apportioning roller 1 for the second time. Hereby a new length of the paper web 39 is passed out of the dispenser so that it can be grasped by hand. Together with this rotation, the nose 5 is guided in the spiral guide beyond the step 4 and the knife 12 is freed from the stopper 42 by the knife spring 13. The nose 5 thus can be returned into its starting position by the return spring 15 which acts on the leg 16 of the knife lever 14 so that the knife 12 is retracted once again.

The paper web 39 is on a dispenser roll 38 which is arranged in the upper part of the dispenser and rests on supporting studs 26. The support stud 26 consists of a pipe end which is given a downward slope and presents an integral part of a tilting bearing 24 pressed through the right 56 and left 57 inside walls, respectively, of the dispenser by a contact pressure spring 25 and connected to the same in a manner so as to be pivotable in and out by means of the swing bolt 23. The swing bolt 23 is received by solid journal bearings 66 arranged at the inside walls 56, 57.

The space between the inside walls 56 and 57 corresponds to the width of the dispenser roll 38. When the dispenser roll 38 is inserted, that is done from below, in other words along the slope 47 of the supporting studs 26 which thus tilt outwardly until the winding tube 76 of the dispenser roll 38 has been reached, in other words up to the time when the contact pressure spring 25 press the supporting studs 26 into the winding tube 76 of the dispenser roll 38. The diameter of the dispenser roll 38 is restricted by a limiter 51 arranged in the back wall 53 so that only dispenser rolls 38 can be introduced that have a defined maximum diameter.

A feeler 31 supported in a bearing bolt 32 rests on the dispenser roll 38 and is held in this contacting position by a feeler spring 33. A joint pin 30 connects the holding rod 29 with the feeler 31 and is guided in a rod guide member 49. The lower part is in engagement with the detent 28 of a swinging plate 27 which can be moved about the pivot pin 22 and carries a tilting bearing 24. Withdrawal of the paper web 39 from the dispenser roll 38 reduces the diameter thereof so that the feeler 31 moves down continuously, whereby the holding rod 29 is pulled up until the holding rod 29 releases the detent 28, when the dispenser roll is almost empty, and the swinging plate spring 48 moves the swinging plate 27 and thus the tilting bearing 24 in the direction of the toothed roller 21. At both its ends the supply roll 40 rests in tilting bearings 24. Yet one of these tilting bearings 24 is located on the swinging plate 27, i.e. the supply roll is pressed by the swinging plate spring 27 in one-sidely offset fashion against the toothed roller 21 which is supported in the toothed roller block 46. The brake 20 thus no longer engages the circumference of the supply roll 40 which, therefore, can rotate freely. The toothed roller 21 presses the paper web 39 coming from the dispenser roll 38 against the supply roll 40 so that the leading end 41 thereof is payed out from the supply roll 40 together with the paper web 39 being withdrawn, reaches the contact pressure rollers 19, and gets to the outlet opening 55 of the dispenser by being guided over the apportioning roller 1.

Two paper webs now are being dispensed simultaneously until the dispenser roll 38 is exhausted, in other words two sheets are removed when the paper web 39 is torn off across the knife 12. This doubling of the paper web 39 lasts until the dispenser roll is exhausted, i.e. in practice from two to five double sheets are dispensed before the unwinding takes place from the supply roll 40 alone. The filling level lever 34 held in position by the filling level spring 36 rests on the supply roll 40 by way of a filling level feeler 37. In this area the cover 54 of the dispenser has a filling level window 35 through which the scale 52 of the filling level lever 34 is visible, thus the filling of the dispenser is visible from outside. The scale 52 is designed such that an alarm is given as early as when $\frac{2}{3}$ of the spare roll have been used up. If the container is refilled in this condition the partly unwound supply roll 40 now is exchanged for the empty winding tube 76 of the dispenser roll 38, and a new supply roll 40 is introduced into the dispenser.

Other than n FIGS. 2 to 8, the release mechanism for the supply roll 40 is of different structure in FIGS. 1 and 9. Here the scanning of the dispenser roll is effected by a slide piece 69 which rests on the dispenser roll 38, forms an integral member with a flat profile piece 71, is pivotable about the pin 70, and includes a peg 72 at the end opposite the slide piece 69. This peg 72 engages in the control fork 73 of an L-shaped piece 74 which is connected to the right inside wall 57 of the dispenser by a supporting pin 75. The front portion of the L-shaped piece 74 includes a hook stop 77 which snaps into engagement behind a protrusion 78 of the tilting bearing 24 arranged on the swinging plate 27.

As the paper web 39 is payed out from the dispenser roll 38 the diameter of the latter decreases so that the slide piece 69 moves in the direction of the winding tube 76. Hereby the flat profile piece 71 rotates with the peg 72 which moves the control fork 73 in the direction of the back wall 53 of the dispenser, thereby turning the L-shaped piece 74 so as to lift the hook stop 77 over the protrusion 78. The tension spring 79 connects a point of the right inside wall 57 with the arm 80 of the swinging plate 27 or tilting bearing 24, thereby pulling the supply roll 40 against the toothed roller 21.

The toothed roller 21 is mounted at the right side of the cover 54 in a toothed roller block 46 which forms an integral component part of the cover 54. The cover 54 is supported in cover bearings 58 which are located in the right and left inside walls 57, 56, respectively. In its upper portion, near the back wall 53, it has a holding slit 67 which is engaged by a resilient hook 68 disposed at the back wall.

The apportioning roller 1 is arranged on bearing blocks 81 in the lower part of the cover 54, thus being tilted forwardly when the cover 54 is swung away so that the paper web 39 can be passed conveniently between the contact pressure rollers 19 and the apportioning roller 1 upon roll replacement.

The shaft 8 of the apportioning roller 1 extends through one of the bearing blocks 81 and, at its outer end, carries a cam segment 63 which comprises a transport surface 64. The cam segment 63 engages the slide surface 60 of the transport lever 59 which is pressed against the cam segment by the transport spring 61. When the paper web 39 is withdrawn and, consequently, the apportioning roller 1 rotates, the cam segment 63 is rotated at the same time, i.e. the slide surface 60 which is on the transport surface 64 when the apportioning roller 1 is at rest slides along the circumference of the cam segment 63, moves the transport lever 59 down, thus tensioning the transport spring 61. The apportioning roller 1 is arrested at the moment when the maximum tensioning of the transport spring 61 is reached. That is effected by the stopper surface 17 of the release anchor 10 abutting against the stop 18 of the apportioning roller 1. The knife 12 swings back after the paper web 39 is torn off so that the locking is cancelled, i.e. the stop 18 and the stopper surface 17 are engaged no longer. As a result, the slide surface 60 rides along the transport surface 64, i.e. the transport spring pulls the transport lever 59 into its inactive position, thus moving the apportioning roller 1 until the stop 18 engages the inner stopper surface 82. The knife 12, therefore, can glide back into its starting position, and another piece of the paper web 39 is transported to the outside.

What is claimed is:

1. An apparatus for paying out sections of a web of material from a dispenser roll, comprising, an apportioning roller (1) having friction means (2) on its outer surface for engaging the web of material from said dispenser roll, a spiral guide (3) on an end surface (43) of said apportioning roller, a stop (18) on said end surface (43) of said roller (1), a knife (12) having a cutting edge for severing a web section from said dispenser roll, a thrust member (6) having one end bearing against said spiral guide on said apportioning roller, a release anchor (10) having spaced stopper surfaces (17, 82), said release anchor having one end pivotably connected to the other end of said thrust member (6), the other end of said release anchor being pivotably coupled to said knife at a point opposite said cutting edge, a knife lever having one end pivotably connected to said knife between said cutting edge and said point opposite said cutting edge and its other end connected to a return spring (15), said stop (18) on said roller and said stopper surface (17, 82) constituting locking means for restraining further rotation of said apportioning roller after a predetermined length of web is payed out.

2. The apparatus as claimed in claim 1, characterized in that the spiral guide (3) is formed with a stop (4).

3. The apparatus as claimed in one of claims 1 and 2, characterized in that the spiral guide (3) is formed as a recess in said end surface (43) of the apportioning roller (1).

4. The apparatus as claimed in claim 3, characterized in that the thrust member (6) bears against the spiral guide (3) with a nose (5).

5. The apparatus as claimed in claim 4, characterized in that the thrust member (6) is formed with an oblong aperture (7).

6. The apparatus as claimed in claim 5 characterized in that the apportioning roller is provided with a shaft (8) and said shaft extends into the oblong aperture (7) in said thrust member (6).

7. The apparatus as claimed in claim 1, characterized in that a contact pressure roller (19) is associated with the apportioning roller (1).

8. The apparatus as claimed in claim 7, characterized in that the paper web (39) is wrapped around the apportioning roller (1) for more than 90° .

9. The apparatus as claimed in claim 1, characterized in that the apportioning roller (1) is connected to a cam segment (63) having a transport surface (64) and engaging a transport lever (59) which is loaded by a transport spring (61).

* * * * *

UNITED STATES PATENT AND TRADEMARK OFFICE

CERTIFICATE OF CORRECTION

PATENT NO. : 5,257,711

DATED : November 2, 1993

INVENTOR(S) : Bernhard Wirtz-Odenthal

It is certified that error appears in the above-identified patent and that said Letters Patent is hereby corrected as shown below:

Col. 3, line 44, "disposed" should read -- is disposed --;

Col. 3, line 58, "outout" should read -- cutout --;

Col. 5, line 3, "At both ..." should start a new paragraph;

Col. 5, line 37, "n" should read -- in --;

Col. 6, line 28, "spring" should read -- spring 61 --;

Col. 6, line 59, "surface" should read -- surfaces --;

Col. 8, line 5, "paper web" should read -- web --.

Signed and Sealed this

Twenty-fourth Day of May, 1994

Bruce Lehman

*Attest:*

BRUCE LEHMAN

*Attesting Officer*

*Commissioner of Patents and Trademarks*